US009516979B2

(12) United States Patent
Gidwell

(10) Patent No.: US 9,516,979 B2
(45) Date of Patent: Dec. 13, 2016

(54) SURFACE CLEANING APPARATUS CONFIGURABLE IN A STORAGE POSITION

(71) Applicant: SharkNinja Operating LLC, Newton, MA (US)

(72) Inventor: Christopher Gidwell, Sherborn, MA (US)

(73) Assignee: SharkNinja Operating LLC, Newton, MA (US)

( * ) Notice: Subject to any disclaimer, the term of this patent is extended or adjusted under 35 U.S.C. 154(b) by 470 days.

(21) Appl. No.: 14/086,475

(22) Filed: Nov. 21, 2013

(65) Prior Publication Data

US 2015/0135474 A1 May 21, 2015

(51) Int. Cl.

| | |
|---|---|
| ***A47L 9/00*** | (2006.01) |
| ***A47L 5/22*** | (2006.01) |
| ***A47L 5/26*** | (2006.01) |
| ***A47L 9/10*** | (2006.01) |
| ***A47L 9/16*** | (2006.01) |
| ***A47L 9/24*** | (2006.01) |

(52) U.S. Cl.

CPC ..... *A47L 5/225* (2013.01); *A47L 5/26* (2013.01); *A47L 9/009* (2013.01); *A47L 9/106* (2013.01); *A47L 9/1683* (2013.01); *A47L 9/246* (2013.01)

(58) Field of Classification Search

CPC ..... A47L 5/24; A47L 5/225; A47L 9/242; A47L 9/02; A47L 5/28

See application file for complete search history.

(56) References Cited

U.S. PATENT DOCUMENTS

| | | | | |
|---|---|---|---|---|
| 4,635,315 | A * | 1/1987 | Kozak | A47L 9/00 15/329 |
| 6,101,669 | A | 8/2000 | Martin et al. | |
| D577,163 | S | 9/2008 | Dyson et al. | |
| D581,609 | S | 11/2008 | Conrad et al. | |
| D585,608 | S | 1/2009 | Conrad et al. | |
| 7,931,716 | B2 | 4/2011 | Oakham | |
| 8,146,201 | B2 | 4/2012 | Conrad | |
| D668,010 | S | 9/2012 | Stickney et al. | |
| D668,823 | S | 10/2012 | Stickney et al. | |
| 8,689,395 | B2 | 4/2014 | Conrad | |
| 2010/0229328 | A1 | 9/2010 | Conrad | |
| 2012/0079671 | A1 * | 4/2012 | Stickney | A47L 5/225 15/344 |

OTHER PUBLICATIONS

International Search Report and Written Opinion for PCT/US2015/012287 mailed May 5, 2015.

* cited by examiner

*Primary Examiner* — Shay Karls
(74) *Attorney, Agent, or Firm* — Grossman Tucker Perreault & Pfleger, PLLC

(57) ABSTRACT

A surface cleaning apparatus may include a surface cleaning head having a dirty air inlet and a support structure moveably mounted to the surface cleaning head. A cleaning unit having an air flow path extending from a cleaning unit air inlet to a clean air outlet, a suction motor and a cyclone chamber provided in the airflow path, and a dirt collection chamber may be configured so that the cleaning unit air inlet is detachably connectable to the support structure to fluidly connect the dirty air inlet. The apparatus can be configured in a use configuration, in which the cleaning unit air inlet is connected to the support structure, and a storage configuration in which the cleaning unit air inlet is disconnected from the dirty air inlet and the cleaning unit is mounted on at least one of the support structure and the surface cleaning head.

19 Claims, 10 Drawing Sheets

SURFACE CLEANING APPARATUS CONFIGURABLE IN A STORAGE POSITION

FIELD

The present subject matter of the teachings described herein relates generally to a surface cleaning apparatus. In a preferred embodiment, the surface cleaning apparatus is configurable in a use position and a storage position.

INTRODUCTION

Various types of surface cleaning apparatus are known. Surface cleaning apparatus include vacuum cleaners. Currently, a vacuum cleaner typically uses at least one cyclonic cleaning stage. More recently, cyclonic hand vacuum cleaners have been developed. See for example, U.S. Pat. No. 7,931,716 and US 2010/0229328. Each of these discloses a hand vacuum cleaner which includes a cyclonic cleaning stage. U.S. Pat. No. 7,931,716 discloses a cyclonic cleaning stage utilizing two cyclonic cleaning stages wherein both cyclonic stages have cyclone axis that extends vertically. US 2010/0229328 discloses a cyclonic hand vacuum cleaner wherein the cyclone axis extends horizontally and is co-axial with the suction motor. In addition, hand carriable (e.g., pod style) cyclonic vacuum cleaners are also known (see U.S. Pat. No. 8,146,201).

SUMMARY

This summary is intended to introduce the reader to the more detailed description that follows and not to limit or define any claimed or as yet unclaimed invention. One or more inventions may reside in any combination or sub-combination of the elements or process steps disclosed in any part of this document including its claims and figures.

According to one broad aspect of the teachings described herein, a surface cleaning apparatus may include a surface cleaning head having a dirty air inlet and a support structure moveably mounted to the surface cleaning head. The support structure may be moveable between an inclined position and an upright position relative to the surface cleaning head. The apparatus may include a cleaning unit having an air flow path extending from a cleaning unit air inlet to a clean air outlet, a suction motor and a cyclone chamber provided in the airflow path, and a dirt collection chamber. The cleaning unit air inlet may be detachably connectable to the support structure to fluidly connect the dirty air inlet and the cleaning unit air inlet. The surface cleaning apparatus may be configurable in a use configuration, in which the cleaning unit air inlet is connected to the support structure and is in air flow communication with the dirty air inlet, and a storage configuration in which the cleaning unit air inlet is disconnected from the dirty air inlet and the cleaning unit is mounted on at least one of the support structure and the surface cleaning head.

A storage mount may be provided on the support structure and the cleaning unit may be mounted to the storage mount when in the storage configuration.

The cleaning unit may be spaced from the surface cleaning head when in the storage configuration.

The storage mount may be provided toward the first end of the rigid suction conduit.

The cleaning unit may include a bottom face configured to rest upon a surface and a mounting member engageable with the storage mount and the mounting member may be provided on the bottom face.

The dirt collection chamber may include at least one openable wall for emptying the dirt collection chamber, and the cleaning unit may include a mounting member engageable with the storage mount and the mounting member may be provided on and may be moveable with the openable wall.

The cleaning unit may include a mounting member engageable with the support structure when in the storage position and the mounting member may at least partially underlie the cyclone chamber and the dirt collection chamber.

The cleaning unit may include a mounting member engageable with the storage mount and the mounting member and storage mount may be configured to retain the cleaning unit on the storage mount solely due to the influence of gravity. Optionally, the mounting member may be removable from the storage mount in the absence of disengaging a locking mechanism.

The cleaning unit may also include a front end, back end and a mounting member engageable with the support structure when in the storage position and the mounting member may be positioned forward of the suction motor.

The storage mount may include an upwardly opening hook member and the cleaning unit may include a mounting member having a slot to receive the hook.

The storage mount may be positioned on a front surface of the support structure and when surface cleaning apparatus is in the storage configuration the mass of the cleaning unit may urge the support structure toward the upright position.

The surface cleaning apparatus may include a first alignment member on the surface cleaning head and a corresponding second alignment member on the support structure, wherein when the support structure is in the upright position relative rotation between the surface cleaning head and the support structure is prevented by engagement between the first and second alignment members.

The support structure may be self-supporting and generally vertically extending when the surface cleaning apparatus is in the storage configuration and the cleaning unit is mounted to the support structure.

The support structure may include an elongate rigid suction conduit having a first end and that is connectable to the cleaning head and a second end that is spaced apart from the first end.

The cleaning unit air inlet may be connectable in air flow communication to the second end of the rigid suction conduit.

The s cleaning unit air inlet may be directly connectable in air flow communication to the second end of the rigid suction conduit.

The cleaning unit may include a centre of gravity and when the cleaning unit is in the storage configuration the centre of gravity may be positioned above the surface cleaning head.

When the cleaning unit is in the storage configuration the suction motor may be at a higher elevation than the mounting member.

DRAWINGS

The drawings included herewith are for illustrating various examples of articles, methods, and apparatuses of the teaching of the present specification and are not intended to limit the scope of what is taught in any way.

DETAILED DESCRIPTION

Various apparatuses or processes will be described below to provide an example of an embodiment of each claimed invention. No embodiment described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an embodiment of any claimed invention. Any invention disclosed in an apparatus or process described below that is not claimed in this document may be the subject matter of another protective instrument, for example, a continuing patent application, and the applicants, inventors or owners do not intend to abandon, disclaim or dedicate to the public any such invention by its disclosure in this document.

Figures 1, 2:
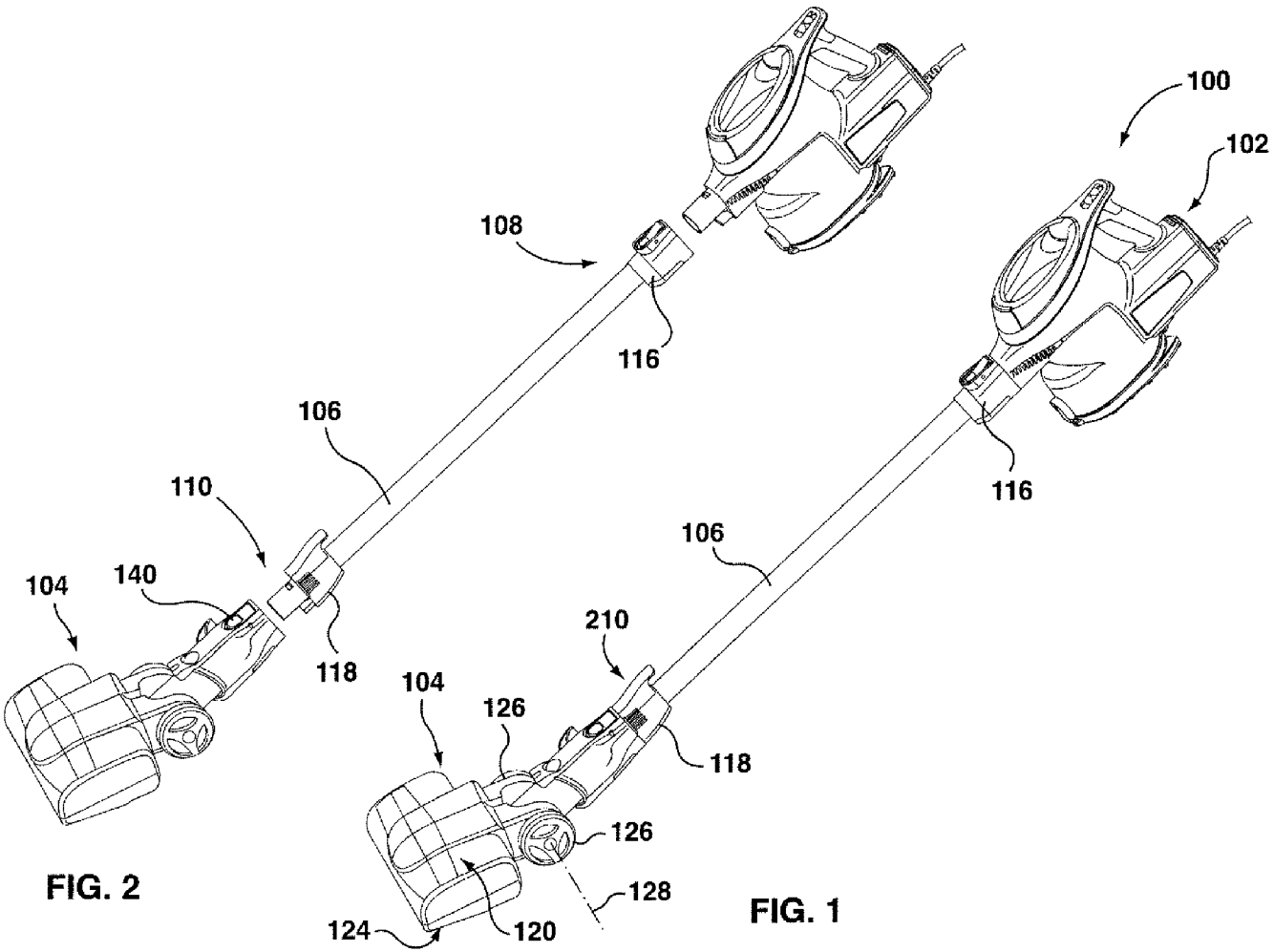
FIG. 1 is a perspective view of an embodiment of a surface cleaning apparatus.
FIG. 2 is a partially exploded view of the surface cleaning apparatus of FIG. 1.

Referring to FIG. 1, an embodiment of a surface cleaning apparatus 100 is shown. In the embodiment illustrated, the surface cleaning apparatus is a hand carriable or hand-held vacuum cleaner. It will be appreciated that surface cleaning apparatus could be carried by a hand of a user, a shoulder strap or the like and could be in the form of a pod or other portable surface cleaning apparatus. The surface cleaning apparatus could be a vacuum cleaner, an extractor or the like. All such surface cleaning apparatuses are referred to herein as a hand carriable surface cleaning apparatus. Optionally, surface cleaning apparatuses could be removably mounted on a base so as to form, for example, an upright vacuum cleaner, a canister vacuum cleaner, a stick vac, a wet-dry vacuum cleaner and the like. Power can be supplied to the surface cleaning apparatus by an electrical cord that can be connected to a standard wall electrical outlet. Alternatively, or in addition, the power source for the surface cleaning apparatus can be an onboard energy storage device, including, for example, one or more batteries.

In the configuration illustrated in FIG. 1, the surface cleaning apparatus 100 includes a cleaning unit 102, a surface cleaning head 104 for rolling along a surface to be cleaned and support structure that extends between the cleaning unit 102 and the surface cleaning head 104. In the illustrated embodiment, the support structure includes a rigid air flow conduit in the form of a wand 106. Alternatively, the support structure may have any other suitable configuration and may, for example, include a rigid structural member in combination with a separate, optionally non-rigid, air conduit, such as a hose.

Figure 3:
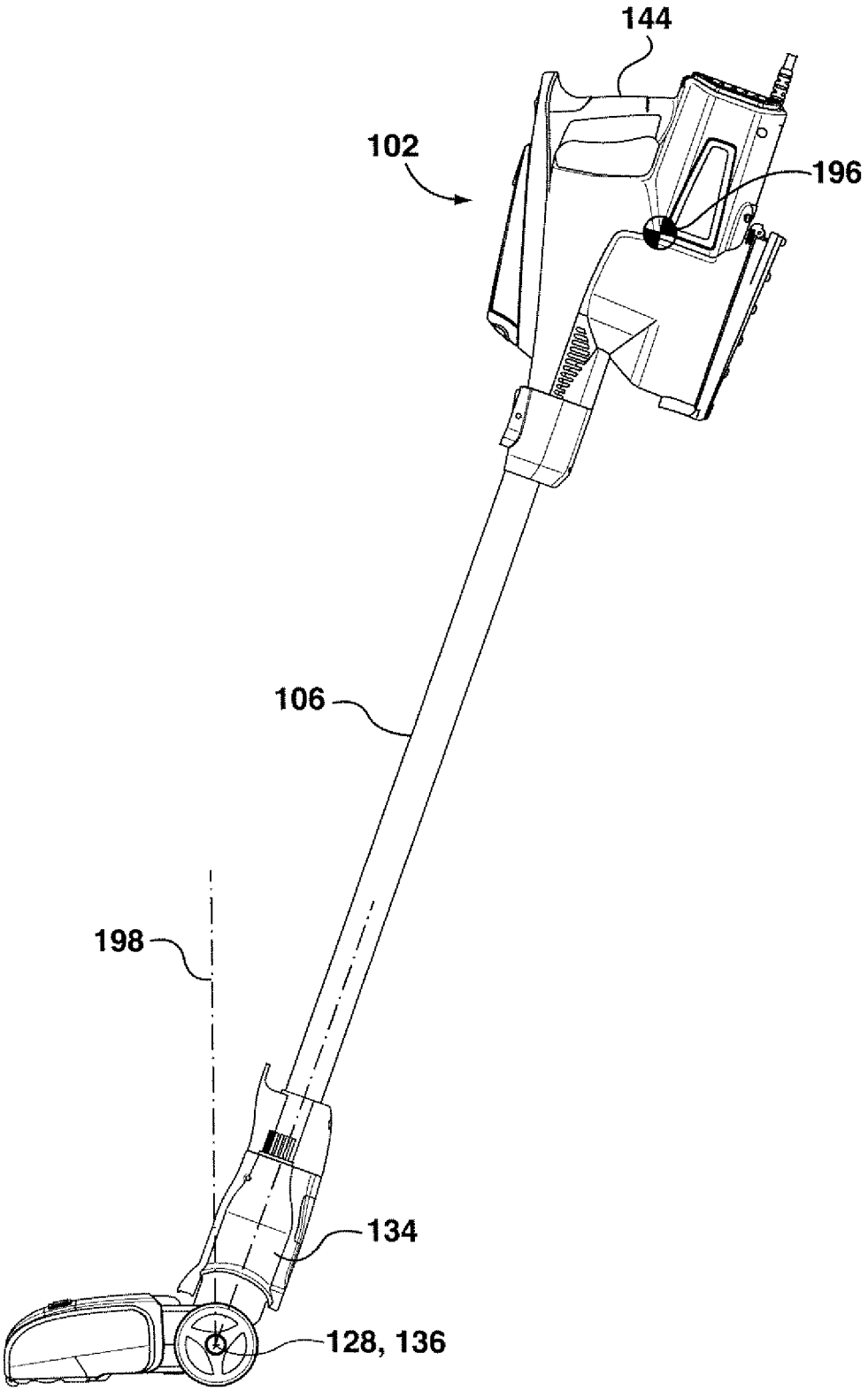
FIG. 3 is a side view of the surface cleaning apparatus of FIG. 1 in an inclined position.

Preferably, the support structure is movably coupled to the surface cleaning head 104. This may allow the support structure and cleaning unit 102 mounted thereto to be moved into a variety of positions relative to the cleaning head 104. For example, in the illustrated embodiment, the wand 106 is pivotally coupled to the surface cleaning head 104 (and optionally may also be rotationally coupled) to the surface cleaning head 104 such that it can be pivoted between an upright position (FIG. 4) and an inclined position (FIG. 3). In both of these configurations the cleaning unit 102 is connected in air flow communication with the surface cleaning head 104, and can be considered to be in a use configuration as the an air flow path is maintained between the surface cleaning head 104 and the cleaning unit 102. The illustrated embodiment of a surface cleaning apparatus 100 can be used to clean a floor or other surface in a manner analogous to conventional upright-style vacuum cleaners.

Figure 4:
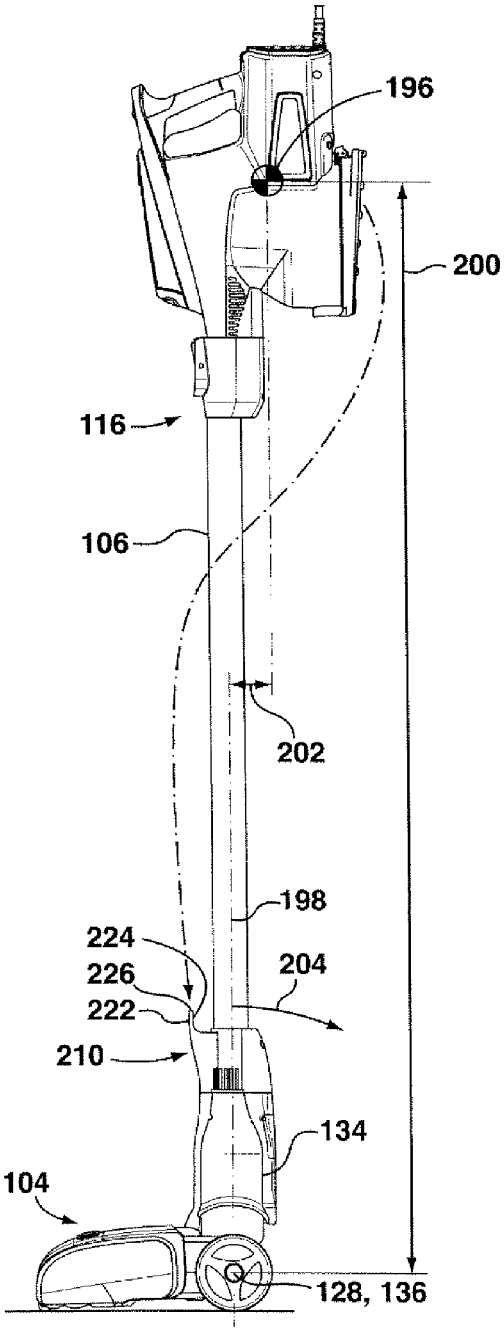
FIG. 4 is a side view of the surface cleaning apparatus of FIG. 1 in an upright position.

The wand 106 may be any type of conduit that can provide air flow communication between the surface cleaning unit 102 and the surface cleaning head 104. In the illustrated embodiment the wand 106 is also rigid such that it can transmit driving forces between the cleaning unit 102 and the surface cleaning head 104. The wand 106 may also be configured so that it has sufficient strength to support the weight of the cleaning unit 102, for example when the support structure is in the upright position (FIG. 4). Optionally, additional stiffening or support members may be provided on the support structure to help support the wand 106 and/or to help transfer the driving force from the cleaning unit 102 to the cleaning head 104.

Figure 11:
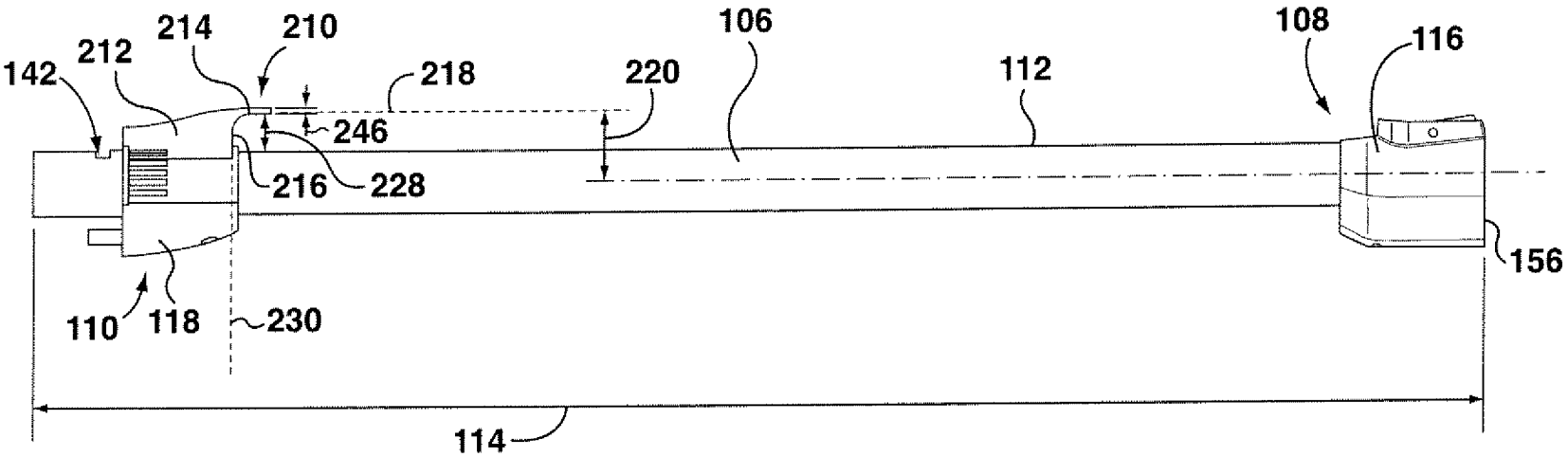
FIG. 11 is a side view of another portion of the surface cleaning apparatus of FIG. 1.

Referring to FIGS. 2 and 11, in the illustrated example, the wand 106 has an upper end 108 and a lower end 110 spaced apart from each other along a wand axis 112 by a wand length 114. The wand length 114 may be any suitable length that provides a desired position of the cleaning unit 102 while the surface cleaning apparatus 100 is in use, and may be, for example between about 40 cm and about 120 cm, between about 70 cm and about 100 cm and/or between about 75 cm and 90 cm. For example, the length 114 may selected so that the cleaning unit 102 is approximately waist height for a user when in the use configuration and/or while in the inclined position (FIG. 1). The upper end 108 includes an upper coupling portion 116 that is configured to detachably connect to the cleaning unit 102. The lower end 110 includes a lower coupling portion 118 that is configured to detachably connected to the surface cleaning head 104 (FIG. 2). Alternatively, the lower end 110 of the wand 106 need not be detachable from the surface cleaning head 104.

Figure 12:
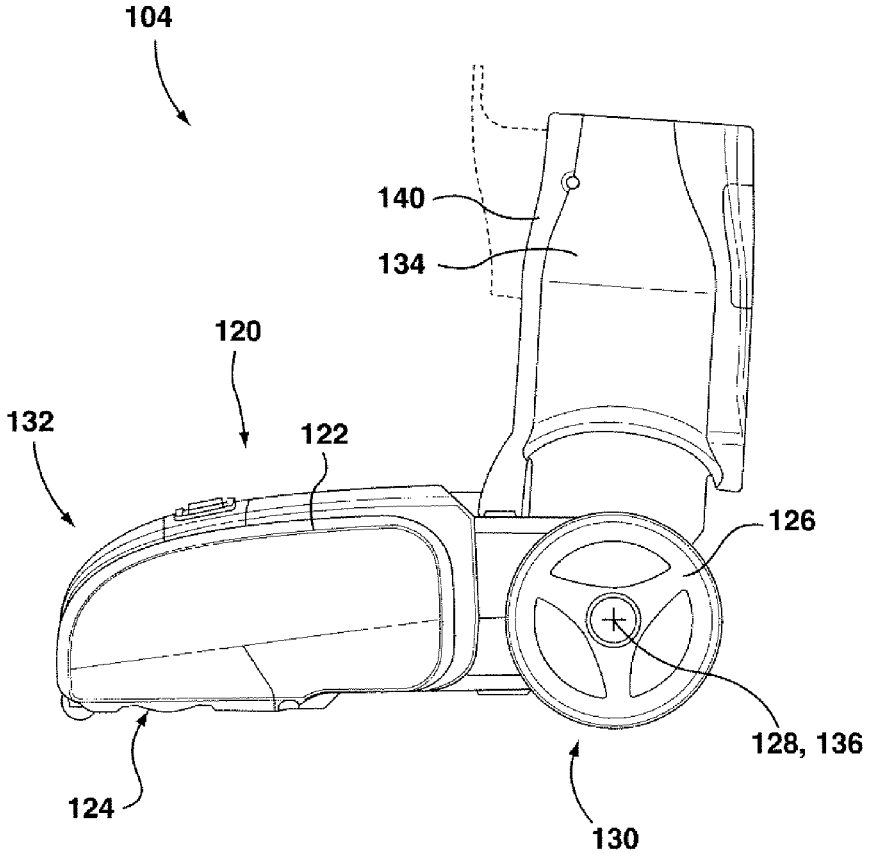
FIG. 12 is a side view of another portion of the surface cleaning apparatus of FIG. 1.

The surface cleaning head may be any suitable type of cleaning head, and may include a variety of different components including, for example, a rotating agitator brush, lights, and other components. Referring the FIGS. 1 and 12, in the illustrated example the surface cleaning head 104 includes a body portion 120 having an outer housing 122 and a dirty air inlet 124. The body portion 120 is supported by a pair of support wheels 126 that are rotatable about a rotation axis 128. The wheels 126 may be of any design and may be provided at any suitable location on the surface cleaning head 104. In the illustrated example, the wheels 126 are provided toward the rear portion 130 of the surface cleaning head 104. The wheels 126 may be the only wheels on the cleaning head 104, or alternatively one or more additional wheels or rollers may be provided toward the front portion 132 of the cleaning head 104. In the present application, the terms front/forward and rear/backward are used with reference to directions in which the surface cleaning apparatus 100 is likely to be moved by a user across a surface. Referring to FIGS. 1 and 12, the front portion 132 is illustrated toward the left side of FIG. 12, and the forward direction is understood to generally to the left as illustrated. For example, in the illustrated embodiment the dirty air inlet 124 is understood to be forward of the wheels 126 and rotation axis 128.

A support post 134 is provided toward the rear of the surface cleaning head 104 and is pivotally coupled to the body 120 (using any suitable pivotable connection, such as an axle or pin joint) so that it can pivot about a pivot axis 136. The pivot axis 136 may be co-axial with the rotational axis 128 of the wheels 126, or alternatively may be spaced apart from, but preferably generally parallel to, the rotational axis 128. In the illustrated embodiment, the rotational axis 128 and the pivot axis 136 are co-linear.

The support post 134 is configured to be detachably coupled to the lower coupling portion 118 on the lower end 110 of the wand 106. Preferably, as illustrated, the lower end 110 of the wand 106 can be fastened to the support post 134 so that it can remain attached when the surface cleaning head 104 is pushed forward and pulled backward via the wand 106. In the illustrated example, the support post 134 includes a releasable latch 140 that can engage a notch 142 (FIG. 11) on the lower coupling portion 118 on the wand 106.

Figure 7:
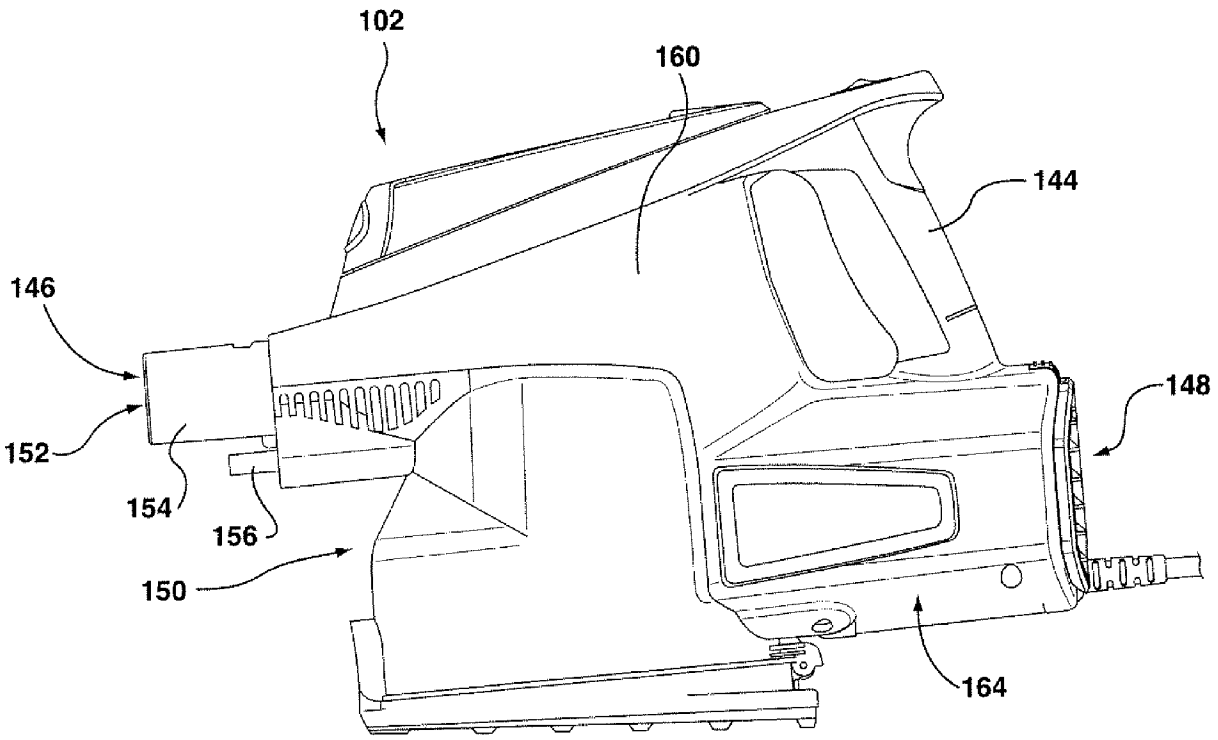
FIG. 7 is a side view of a portion of the surface cleaning apparatus of FIG. 1.
Figure 8:
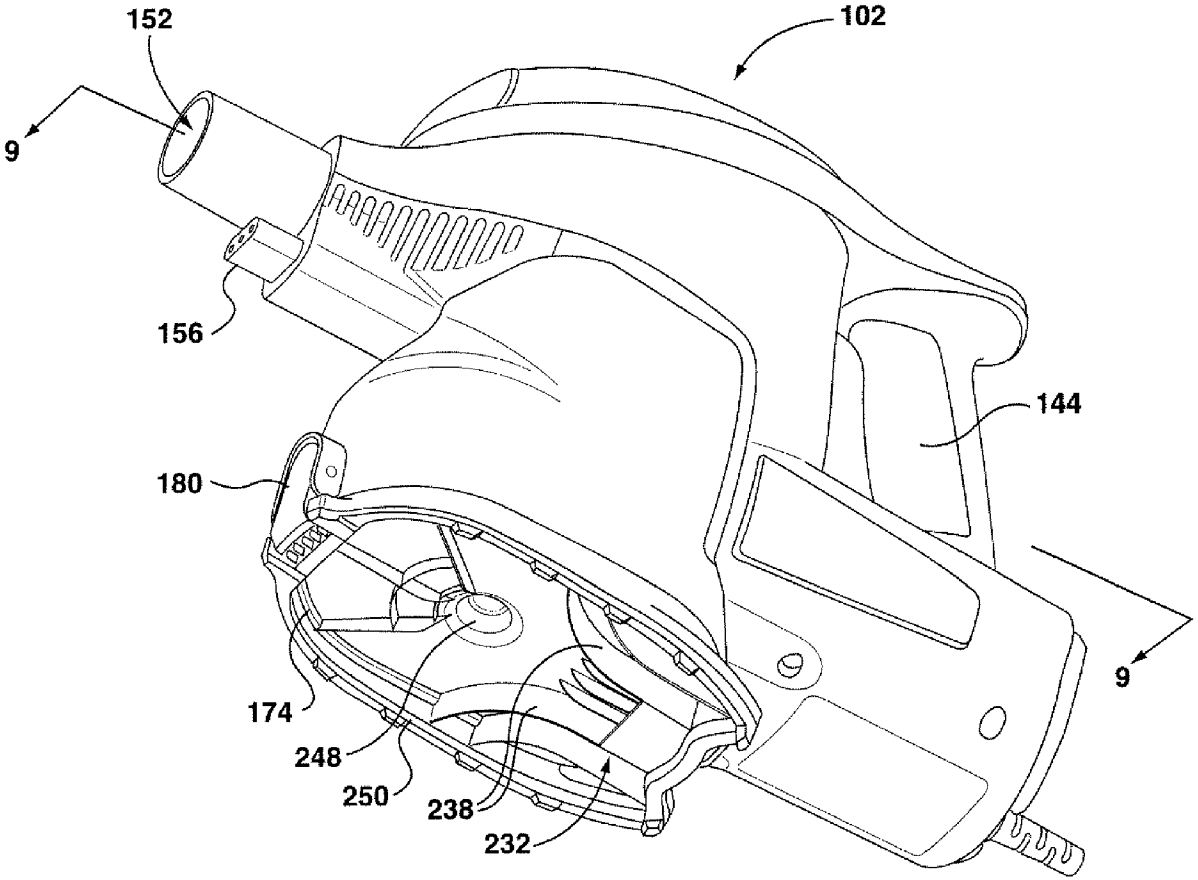
FIG. 8 is perspective view of a portion of the surface cleaning apparatus of FIG. 1.

Referring to FIG. 7, in the illustrated embodiment, the cleaning unit 102 includes a handle 144, a dirty air inlet 146, a clean air outlet 148, an air flow path extending therebetween and an air treatment member 150 in the airflow path. In the embodiment shown, the dirty air inlet 146 is the inlet end 152 (see also FIG. 8) of a connector 154. Optionally, the inlet end 152 can be used to directly clean a surface. Alternatively, the inlet end 152 can be connected to the downstream end of any suitable hose, conduit, cleaning tool or accessory, including, including the wand 106 as illustrated. The cleaning unit 102 also defines a cleaning unit length 145. The cleaning unit length 145 may be any suitable length, and may be between about 20 cm and about 50 cm, or may be less than 20 cm or greater than 50 cm. Optionally, as illustrated, the cleaning unit length 145 may be less than the wand length 114, and preferably may be between about 10% and about 70%, between about 30% and about 60% and/or between about 40% and about 50% of the wand length 114.

The connector 154 may be any suitable connector that is operable to connect to, and preferably detachably connect to, a hose, cleaning tool, other accessory and/or the wand 106 as illustrated. In addition to providing an air flow connection, in the illustrated example the connector also includes an optional electrical connection which may allow cleaning tools and accessories that are coupled to the connector to be powered by the surface cleaning apparatus. For example, the surface cleaning unit 102 can be used to provide both power and suction to a surface cleaning head 104, or other suitable tool. In the illustrated embodiment, the connector 152 includes an electrical coupling in the form of a first connector 154 and a corresponding second connector 156 (FIG. 11) is provided on the upper coupling portion 116 of the wand 106. Another electrical coupling is provided between the lower end of the wand and the surface cleaning head.

From the dirty air inlet 146, the air flow path extends downstream through the air treatment member 150. The air treatment member 150 may be any suitable member that can treat the air in a desired manner, including, for example, removing dirt particles and debris from the air. In the illustrated example, the air treatment member 150 is provided in the form of a cyclone bin assembly 150. Alternatively, the air treatment member can comprise a bag, a filter or other air treating means.

In the illustrated embodiment, the cyclone bin assembly 150 forms part of the main body 160 of the cleaning unit 102. A suction motor 162 (see FIG. 9) is mounted within a motor housing portion 164 of the main body 160 and is in fluid communication with the cyclone bin assembly 150. In this configuration, the suction motor 162 is downstream from the cyclone bin assembly 150 and the clean air outlet 148 is downstream from the suction motor 162.

The following is a description of a cyclone and a cyclone bin assembly 150 that may be used by itself in any surface cleaning apparatus or in any combination or sub-combination with any other feature or features disclosed herein.

Figure 9:
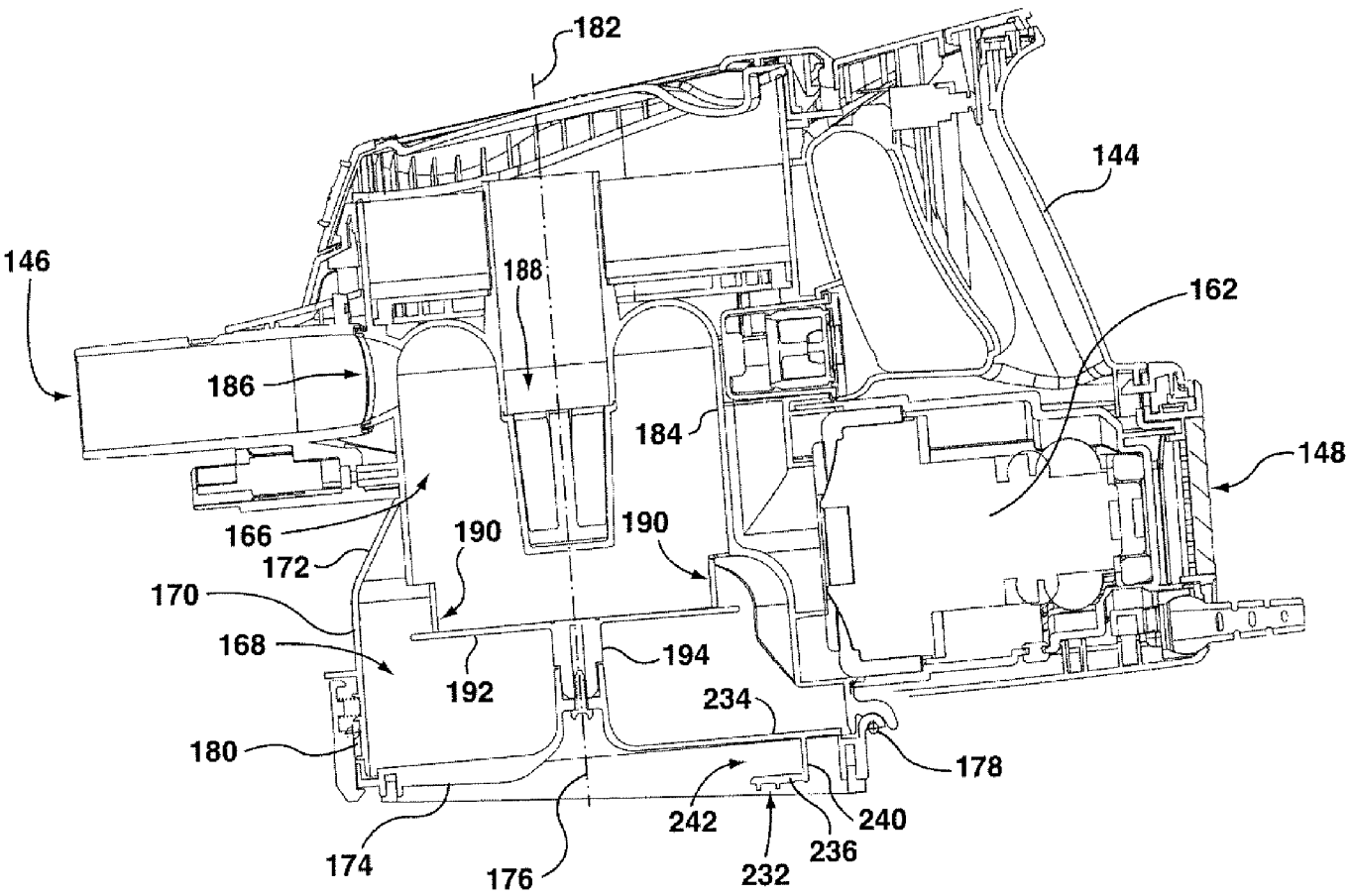
FIG. 9 is a section view taken along line 9-9 in FIG. 8.

Referring to FIG. 9, in the illustrated embodiment, the cyclone bin assembly 150 includes a cyclone chamber 166 and a dirt collection chamber 168. The cyclone chamber 166 and the dirt collection chamber 168 may be of any suitable configuration.

In the illustrated embodiment the dirt collection chamber 168 is positioned outside or exterior to and substantially below the cyclone chamber 166. Preferably, a least a portion, if not all, of the dirt collection chamber 168 is below the cyclone chamber 166. The dirt collection chamber 168 comprises a sidewall 170, a first end wall 172 and an opposed second end wall 174. The dirt collection chamber extends along a dirt collection axis 176.

Figure 10:
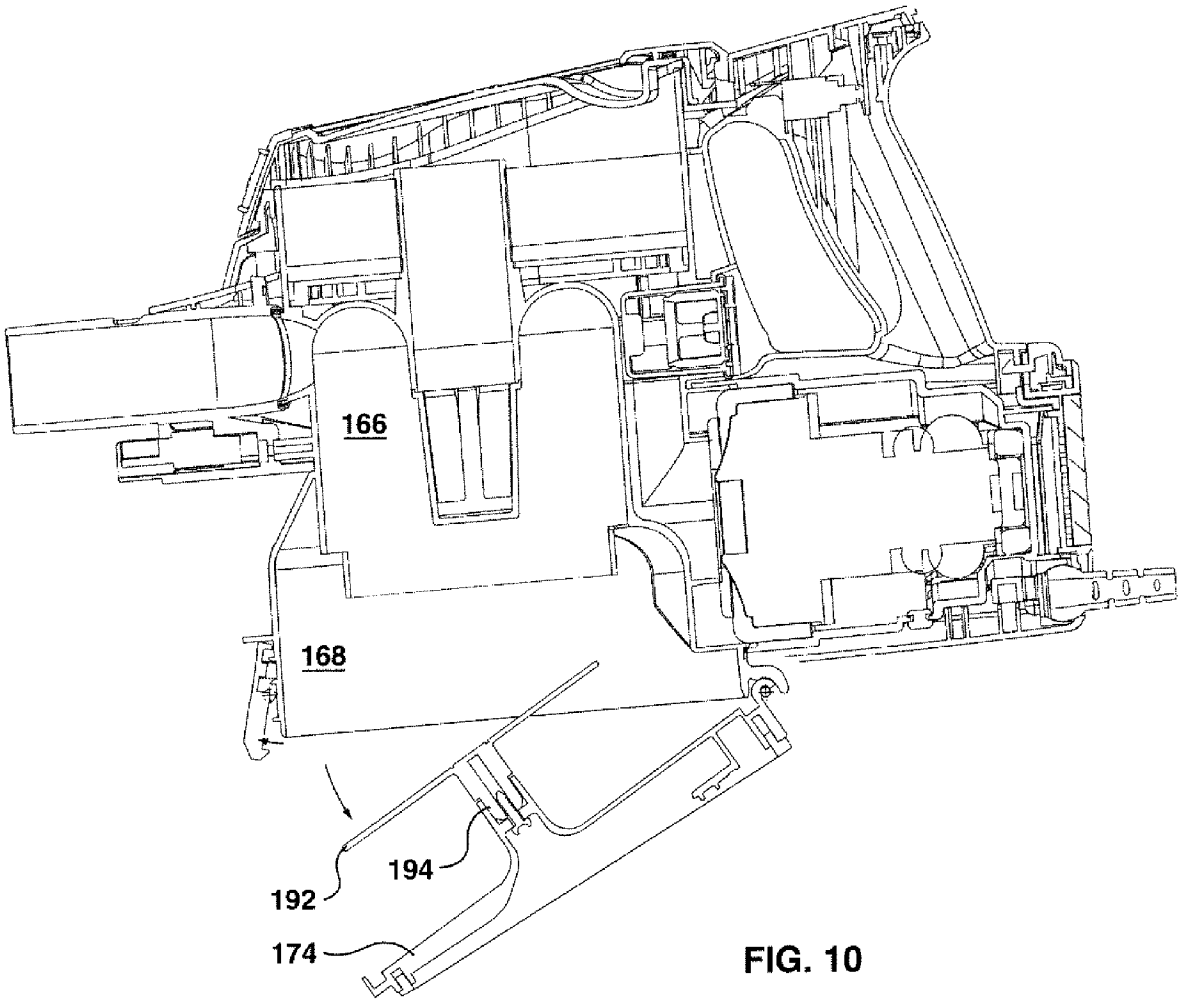
FIG. 10 is the section view of FIG. 9 with an end wall in an open position.

The dirt collection chamber 168 may be emptyable by any means known in the art and is preferably openable concurrently with the cyclone chamber 166. Preferably, the second dirt collection chamber end wall 174 is openable to allow the dirt collection chamber 168 to be emptied. Preferably, the end wall 174 may be moveably connected to the cleaning unit 102, and more preferably may be pivotally connected to the dirt collection chamber sidewall 170, for example using hinge 178 as illustrated. In this configuration, the second dirt collection chamber end wall 174 functions as an openable door to empty the dirt collection chamber 168 and can be opened as shown in FIG. 10 to empty dirt and debris from the interior of the dirt collection chamber 168. The second dirt collection chamber end wall 174 can be retained in the closed position by any means known in the art, such as by a releasable latch 180. In the illustrated example, the hinge 178 is provided on a back edge of the end wall 174 and the latch 180 is provided at the front of the end wall 174 so that the door swings backwardly when opened. Alternatively, the hinge and latch may be in different positions, and the door may open in a different direction or manner. Alternatively, instead of being moveably connected, the end wall 174 may be detachable or removable.

In the embodiment shown, the cyclone chamber 166 extends along a cyclone axis 182 and is bounded by a sidewall 184. The cyclone chamber 166 includes an air inlet 186 and an air outlet 188 and two dirt outlets 190 in communication with the dirt collection chamber 168. The air inlet 186, air outlet 188 and dirt outlets 190 may be of any design known in the art.

In the example illustrated the cyclone bin assembly 150 and the cyclone chamber 166 therein are arranged in a generally vertical, inverted cyclone configuration. In this configuration, the air inlet 186 and the air outlet 188 are provided toward the upper end of the cyclone chamber 166. Alternatively, the cyclone bin assembly and cyclone chamber can be provided in another orientation, including, for example, as a horizontal cyclone or in other configurations, e.g., with the dirt collection chamber beside the cyclone chamber and/or with the inlet and outlets at differing positions.

In alternative embodiments, the cyclone chamber may include only a single dirt outlet, or more than two dirt outlets.

A deflector or arrestor plate 192 may be positioned at the lower end of the cyclone chamber 166, at the interface between the cyclone chamber 166 and the dirt collection chamber 168. The arrestor plate 192 is preferably sized to cover substantially all of the lower end of the cyclone chamber 166, and to abut the lower end of the cyclone sidewall 184 to form a lower end wall of the cyclone chamber 166. When the arrestor plate 192 abuts the lower ends of the sidewall 184 it helps define the gaps or slots that form the dirt outlets 190. In this configuration, the dirt outlet slots 190, are bounded on three sides by the cyclone chamber sidewall 184 and on a fourth side by the arrestor plate 192. Alternatively, the dirt outlet slots 190 may be entirely bounded by the sidewall 184 and may be spaced apart from the arrestor plate 190.

In the illustrated embodiment, the arrestor plate 192 forms the bottom of the cyclone chamber 166 and may be of any suitable configuration. Optionally the arrestor plate 192 may be fixed in its position adjacent the sidewall 184, or may be moveable or openable. Providing an openable arrestor plate 192 may help facilitate emptying of the cyclone chamber 166. Optionally, the arrestor plate may be openable concurrently with another portion of the surface cleaning apparatus, including, for example, the dirt collection chamber.

In the illustrated embodiment, the arrestor plate 192 is mounted to and supported spaced from the openable wall 174 by a support member 194. The support member 194 may be of any suitable configuration and may be formed from any suitable material that is capable of supporting the arrestor plate 192 and resisting stresses exerted on the arrestor plate by the air flow in the cyclone chamber 166 or dirt particles exiting the cyclone chamber 166. In this configuration, the arrestor plate 192 is openable concurrently with the end wall 174 so that opening the end wall simultaneously opens the dirt collection chamber 168 and the cyclone chamber 166. Alternatively, the arrestor plate 192 may be mounted to the sidewall 184 (or other portion of the surface cleaning apparatus) and need not open in unison with the end wall 174, or at all.

Referring to FIG. 3, when the wand 106 is in the inclined position, a user can carry the vacuum cleaner via the handle 144 and most of the weight of the cleaning unit 102 is supported by the user. Optionally, in some instances, some of the weight of the cleaning unit 100 may be transferred to the surface cleaning head 104 via the wand 106. However, the surface cleaning head 104 and wand 106 are not configured to independently support the cleaning unit 102 in the inclined position (FIG. 3) without assistance from the user. In the inclined position, the centre of gravity 196 of the cleaning unit 102 is located above and behind the surface cleaning head 104, and specifically behind a plane 198 containing the rotational axis 128 and the pivot axis 136. If a user were to release the cleaning unit 102 in this configuration, it is likely that the surface cleaning unit 102 would fall over, probably in a generally rearward direction.

When not in use, the surface cleaning apparatus 100 may be stored. Referring to FIG. 4, when the surface cleaning apparatus 100 is stored the wand 106 may be pivoted to its upright position. However, in the illustrated configuration, if the cleaning unit 102 remains attached to the upper end 108 of the wand 106 when the wand 106 is in the upright position, the surface cleaning apparatus 100 may be unstable, and may tend to fall over when unattended or jostled. For example, in the illustrated example, when the wand 106 is in the upright position and the cleaning unit 102 is still attached, the centre of gravity 198 of the cleaning unit 102 is spaced above the axes 128, 136 by a height 200 and is offset behind the axes 128, 136 by an offset distance 202.

In this configuration, the centre of gravity 198 is offset behind the surface cleaning head 104, and does not overlie the surface cleaning head 104. With the cleaning unit 102 in this position the weight of the cleaning unit 102 exerts a rotational moment force 204 about the axes 128, 136 that urges the surface cleaning head 104 and wand 106 in a generally rearward direction. If the magnitude of the moment force 204 is sufficiently large it may cause the surface cleaning apparatus 100 to fall over backwards. Even if the moment force 204 is not sufficiently large to cause the surface cleaning apparatus 100 to fall over on its own, it is a generally destabilizing force which may make the surface cleaning apparatus 100 more prone to fall over when subjected to an external force while stored (such as being contacted by a child, a pet, a user or another object). A surface cleaning apparatus that falls over while stored/unattended may cause damage to the cleaning unit, other portions of the surface cleaning apparatus, surrounding objects and/or may pose a safety hazard for people and pets that are in proximity to the surface cleaning apparatus.

To help improve stability of the surface cleaning apparatus while stored/not in use, the surface cleaning apparatus 100 may be configured so that the cleaning unit air inlet 146 is disconnected from the dirty air inlet 124 (i.e. detached from the upper end of the wand 106) and the cleaning unit 102 is mounted on the support structure at a different location or the surface cleaning head. For example, the cleaning unit 102 can be detached from the upper end 108 of the wand 106 and attached to the support structure at a lower elevation and/or a more forward position (as compared to when the cleaning unit air inlet 146 is connected to the upper end of the wand 106). This may alter the location of the centre of gravity 196 and may affect the stability of the surface cleaning apparatus. Alternatively, the cleaning unit 102 may be mounted directly to the surface cleaning head 104.

The cleaning unit 102 may be mounted to the support structure using any suitable mechanism. For example, in the illustrated example the support structure is provided with a storage mount that is configured to receive and support the cleaning unit 102 when the surface cleaning apparatus is not in use. The storage mount may be any suitable member, and preferably may be provided on a lower portion of the wand 106 (e.g. below the midpoint 115 of the wand 106, see FIG. 5), a portion of the surface cleaning head 104 or any other suitable location, which can support the cleaning unit 102 in a storage configuration in which it is spaced apart from the upper end 108 of the wand 106. Preferably, when in the storage configuration the cleaning unit 102 is positioned at a lower elevation than the upper end 108 of the wand 106. Optionally, the surface cleaning apparatus 100 can be configured so that when the cleaning unit 102 is in the storage configuration the centre of gravity 196 of the cleaning unit 102 is disposed directly above, or preferably forward of the axes 128, 136, and overlies the body 120 of the surface cleaning head 104. For example, in the illustrated example the storage mount is provided on a front portion of the wand 106.

Positioning the cleaning unit 102 forward of one or both of the axes 128, 136 may cause the cleaning unit 102 to exert a generally forwardly acting moment force 206 (FIG. 5) on the wand 106 and surface cleaning head 104, and may locate the centre of gravity 196 of the cleaning unit 102 directly above the surface cleaning head 104. In such a position, the forward moment force 206 may tend to urge the wand 106 to pivot about its pivot axis 136 in a forward direction. Such forces may be balanced by reaction forces 208 between the surface cleaning head 104 and the underlying surface which may tend to prevent the surface cleaning apparatus 100 from falling forward. This may increase the stability of the surface cleaning apparatus 100 when in the storage configuration. Preferably, when in the storage configuration and the cleaning unit 102 is mounted on the support structure, the support structure is self-supporting and generally vertically extending.

Optionally, the same connector that is used to couple the surface cleaning unit to the upper end of the wand (e.g. connector 154) may function as a mounting member that can be used to attach the cleaning unit to the storage mount. This may allow the cleaning unit 102 to include only one attachment connector. Alternatively, the cleaning unit 102 may include a mounting member that is separate from the connector 154. Providing a separate mounting member may allow the mounting member to have a different configuration, position and/or functionality than the connector 154. For example, the mounting member may be configured as a gravity mount that is free from latches or other types of retaining mechanisms. This may allow a user to place the cleaning unit 102 on the storage mount, and retrieve it from the storage mount using a single hand, and without the need to disengage any locks or latches.

Referring to FIG. 4, in the illustrated embodiment the surface cleaning apparatus 100 is provided with a storage mount in the form of mount 210 (see also FIGS. 1 and 11) In the illustrated embodiment, the mount 210 is provided on a front surface of the wand 106, and is positioned toward the lower end 110 of the wand 106. Alternatively, it may be in a different location, and optionally may be provided on the surface cleaning head instead of the wand.

Referring to FIG. 11, in the illustrated embodiment the mount 210 includes a body portion 212 that includes a generally upwardly extending protrusion member 214 and a base surface 216 extending between the protrusion member 214 and the front surface of the wand 106.

The protrusion member 214 extends along a protrusion axis 218. In the illustrated embodiment the protrusion axis 218 is generally parallel to the wand axis 112 and is spaced apart from the wand axis 112 by a forward offset distance 220. The protrusion member 214 may be made of any suitable material, and in the example illustrated is formed from plastic that is integrally molded with the body portion 212.

Figure 6:
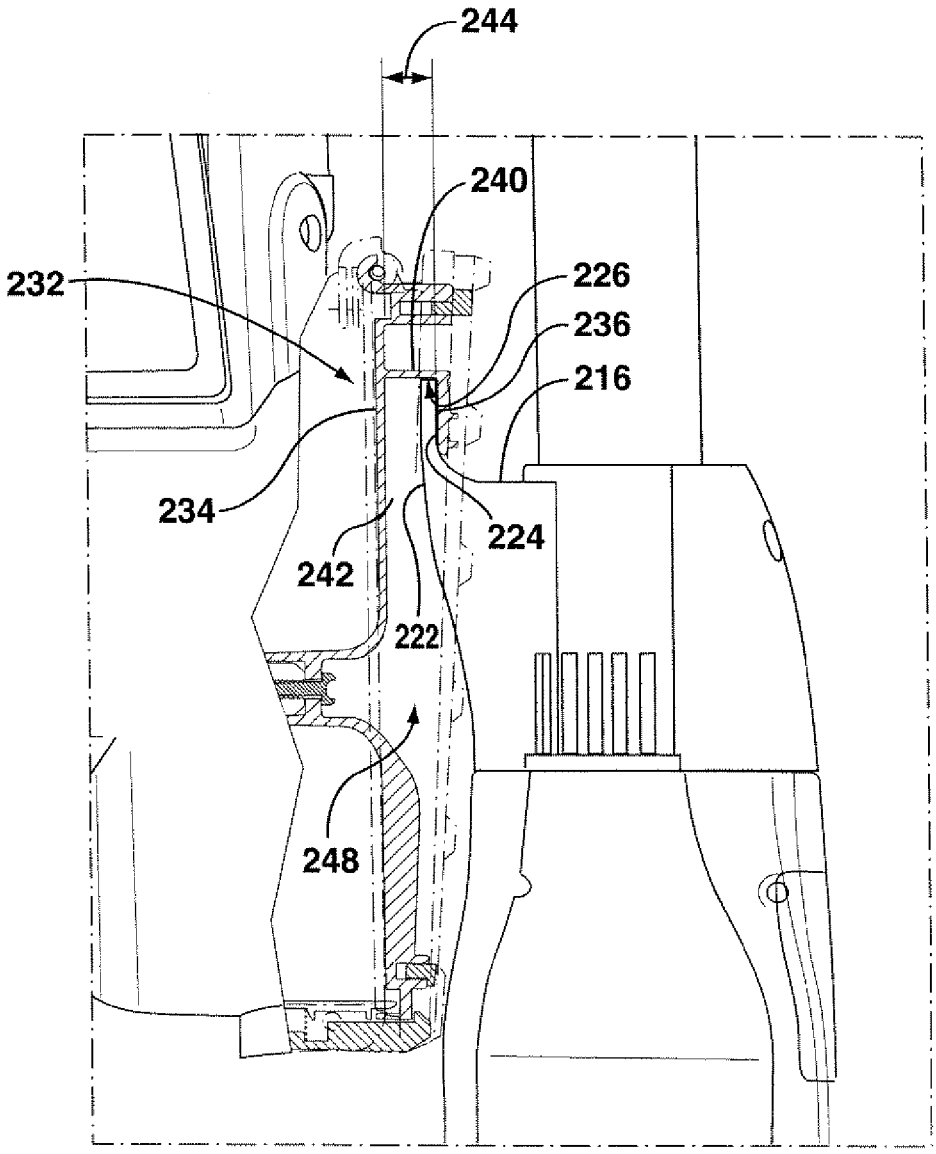
FIG. 6 is enlarged view of a portion of FIG. 5, with a portion of the surface cleaning apparatus shown in section.

In the illustrated embodiment, the protrusion member 214 has a generally rectangular axial cross-sectional area and includes spaced apart front and rear surfaces 222 and 224 and a generally upwardly facing end surface 226 (see also FIG. 6). The rear surface 224 of the protrusion is spaced apart from the front surface of the wand 106 by a distance 228 to provide a gap to receive a portion of the cleaning unit 102. The distance 228 may be any suitable distance, based on the configuration of the cleaning unit 102, and may be, for example, between about 3 mm and about 50 mm or more. Preferably, the distance 228 is between about 10 mm and about 25 mm.

The base surface 216 may be of any suitable configuration, and in the illustrated example is generally planar and lies in plane 230 (FIG. 11). In the illustrated configuration plane 230 is generally orthogonal to the wand axis 112 and the protrusion axis 218, but may be oriented differently in other embodiments.

To support the cleaning unit 102 on the mount 210, the cleaning unit is provided with a complimentary mounting member that is configured to engage the mount 210. The mounting member may be any suitable mechanism or member that is compatible with the storage mount provided on the support structure or the surface cleaning head.

In the illustrated embodiment, the mounting member is provided in the form of a recess 232 (FIGS. 6 and 8) on the cleaning unit 102 that is sized to slidingly receive the protrusion member 214 and is provided on the bottom surface of the dirt collection chamber end wall 174. In the illustrated embodiment, the dirt collection chamber end wall 174 functions as an openable door, and the recess 232 is moveable relative to the rest of the cleaning unit 102, with the openable door 174. Alternatively, the recess 232 may be provided on another portion of the cleaning unit 102, and need not be moveable.

In the illustrated embodiment, the bottom of the dirt collection chamber end wall 174 also functions as supporting surface that is generally planar and is configured to support the cleaning unit 102 if it is placed on a counter or other surface. Preferably, to help preserve the supporting surface function, the recess 232 is formed in the interior of the dirt collection chamber sidewall 174, and does not extend beyond or proud of the bottom surface. This may help the cleaning unit 102 to sit evenly on a surface.

In this configuration, the recess 232 is an internal recess that is bounded by opposed front and rear walls 234 and 236, a pair of spaced apart sidewalls 238 and an endwall 240 at a closed end of the recess 232 (this orientation relates to when the cleaning unit is mounted on the mount, is merely for ease of reference and is not intended to be limiting or directed to a particular orientation). The recess 232 also has an open end 242 that is spaced apart from the endwall 240 and sized for receiving the protrusion 214. A spacing between the front and rear walls 234 and 236 defines a recess width 244.

In the illustrated example, the recess 232 is integrally molded within the dirt collection chamber end wall 174. Alternatively, the recess may be provided by one or more separate members that are affixed to the cleaning unit.

Referring to FIG. 6, when the protrusion 214 is received within the recess, the rear wall 236 of the recess bears against the rear surface 224 of the protrusion 214 and the endwall 240 of the protrusion bears against the end surface 226 of the protrusion 216. Because, in the illustrated configuration, the recess width 244 is greater than a protrusion width 246 (FIG. 11), front wall 234 of the recess 232 remains spaced apart from the front surface 222 of the protrusion 214.

Providing a recess width 244 that is greater than the protrusion width 246 may help facilitate easy, interference free insertion and removal of the protrusion 214 relative to the recess 232. For example, in the illustrated example, the recess width 244 is between about 250% and about 300% of the protrusion width 246, and in other examples may be between about 125% and about 500% or more of the protrusion width 246. Alternatively, the recess width 244 may be selected to be generally equal to or only slightly bigger than the protrusion width 246, for example between about 100% and about 150% of the protrusion width 246.

This may provide a snug engagement and/or a slight interference fit between the protrusion 214 and the recess 232.

In the illustrated example, the dirt collection chamber end wall 174 also includes a cavity 248 (FIG. 8) that is external to the recess 232, but in communication with the open end 242 of the recess 232. The cavity 248 is generally bounded by a sidewall 250 or rim and is sized to receive the protrusion member 214. The cavity 250 may provide additional clearance for receiving the protrusion member 214 and may help facilitate engagement of the protrusion 214 within the recess 232. In this configuration, to position in the cleaning unit 102 on the mount 210, the cavity 248 can be positioned adjacent the protrusion 214, and the cleaning unit 102 can be shifted laterally (i.e. rearwardly as shown) so that the protrusion 214 is positioned within the cavity 248 and is aligned with the open end 242 of the recess 232. The cleaning unit 102 can then be moved axially downward (in the direction of the protrusion axis 218) to insert the protrusion 214 within the recess 232. To remove the cleaning unit 102 it may be pulled generally upwardly, or generally upwardly and forwardly (see arrows 254 and 256 respectively) to disengage the protrusion 214 from the recess 232, and separate the cleaning unit 102 from the mount 210. Alternatively, instead of a generally vertical or axial movement, the mount may be configured to receive the mounting member in a generally horizontal or lateral direction.

Configuring the recess 232 to generally vertically receive the protrusion 214 may allow a user to manipulate the cleaning unit 102 via its handle 144 during the mounting operation, and may allow the cleaning unit 102 to be mounted/dismounted in generally the same orientation that it is in when mounted to the upper end 110 of the wand 106. Providing generally vertical or upright engagement between the protrusion 214 and the recess 232 may also facilitate the cleaning unit 102 being held on the mount 210 and in the storage configuration by gravity, and without the need for additional latches or retaining mechanisms.

In the illustrated embodiment, when the cleaning unit 102 is in the storage configuration (FIG. 5) the suction motor 162 is disposed at a higher elevation than the protrusion 214 and the recess 232. In this configuration the centre of gravity 196 of the cleaning unit is also located above the mount 210. In this arrangement the weight of the cleaning unit 102 may tend to urge the cleaning unit 102 into engagement with the mount 210 (i.e. urge recess endwall 240 against with the protrusion end surface 226), as opposed to urging the cleaning unit 102 away from the mount 210.

Also, in the illustrated embodiment, when the cleaning unit 102 is in the storage configuration the recess 232 and the protrusion 214 are generally aligned with and on the same elevation as the cyclone chamber 166 and the dirt collection chamber 168 (along the dirt collection chamber axis 176), and the dirt collection chamber 168 is axially intermediate the recess 232 and the cyclone chamber 166. Further, in the illustrated embodiment, when the cleaning unit 102 is in the storage configuration the suction motor 162 is positioned between the handle 144 and the support structure and overlies a portion of the cyclone chamber 166 and the dirt collection chamber 168.

Figure 5:
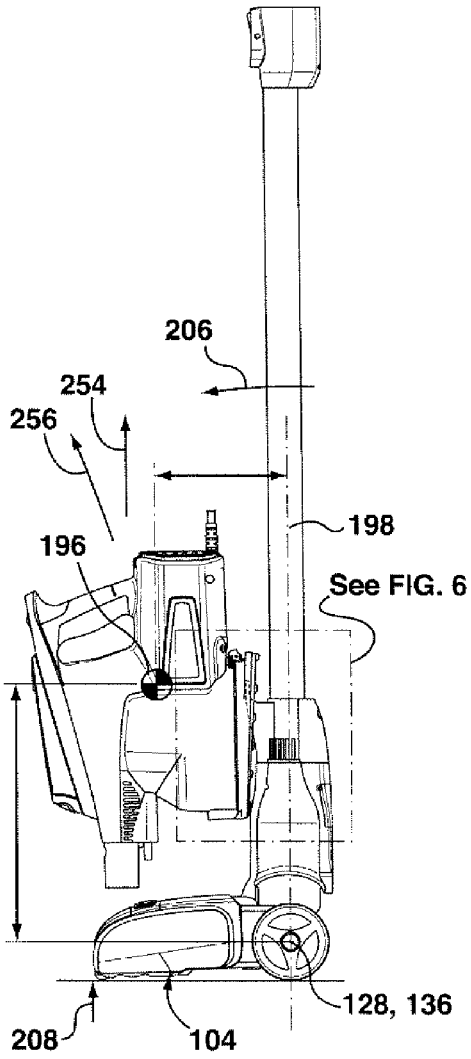
FIG. 5 is a side view of the surface cleaning apparatus of FIG. 1 in a storage configuration.

Referring still to FIG. 5, in the illustrated example when the cleaning unit 102 is mounted to the wand 106 the entirety of the cleaning unit 102 is disposed below the midpoint 115 of the wand 106, and the centre of gravity 196 is forward of the support structure and above the cleaning head 104.

Optionally, portions of the front wall 234, rear wall 236 and sidewalls 238 adjacent the open end 242 of the recess 232 may be curved or flared in a generally outwardly direction to define guiding surfaces. The guiding surfaces may help direct the protrusion 214 into the recess 232, and may help facilitate mounting of the cleaning unit 102 in the storage configuration.

Optionally, a locking mechanism, such as a latch or other suitable member, may be provided to secure the cleaning unit in the storage configuration. The locking mechanism may act directly on the mount (i.e. a mechanism to lock the protrusion within the recess) or may act between other components, such as between the wand and housing of the cleaning unit.

Alternatively, instead of a positively locking mechanism, the mount may be include a retaining mechanism, such as a detent that may help hold the cleaning unit in the storage configuration, without positively locking it in place or preventing removal by a user.

While illustrated with a protrusion 214 on the wand 106 and a recess 232 on the cleaning unit 102, the location of these components may be switched. For example, instead of including a protrusion, the mount may include a recess or slot provided on the wand or surface cleaning head, and the cleaning unit may include a protrusion that can be inserted into the recess.

Optionally, instead of being provided on the wand, the mount member may be provided on the surface cleaning head, and optionally may be provided on the support post, as illustrated using phantom lines in FIG. 12.

Alternatively, instead of providing the mounting member, i.e. the recess 232 in the illustrated embodiment, on the bottom of the dirt collection chamber end wall 174, it may be provided on any other portion of the cleaning unit 102. For example, the mounting member may be provided on a non-moveable portion of the cleaning unit, such as, for example, the sidewall 172 of the dirt collection chamber 166 and the motor housing.

What has been described above has been intended to be illustrative of the invention and non-limiting and it will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

The invention claimed is:

1. A surface cleaning apparatus comprising:

a surface cleaning head having a dirty air inlet;

a support structure moveably mounted to the surface cleaning head and moveable between an inclined position and an upright position relative to the surface cleaning head;

a cleaning unit having an air flow path extending from a cleaning unit air inlet to a clean air outlet, a suction motor and a cyclone chamber provided in the airflow path, and a dirt collection chamber, the cleaning unit air inlet detachably connectable to the support structure to fluidly connect the dirty air inlet and the cleaning unit air inlet;

the surface cleaning apparatus is configurable in a use configuration, in which the cleaning unit air inlet is connected to the support structure and is in air flow communication with the dirty air inlet, and a storage configuration in which the cleaning unit air inlet is disconnected from the dirty air inlet and the cleaning unit is mounted on at least one of the support structure and the surface cleaning head.

2. The surface cleaning apparatus of claim 1, further comprising a storage mount provided on the at least one of the support structure and surface cleaning head and the cleaning unit is mounted to the storage mount when in the storage configuration.

3. The surface cleaning apparatus of claim 2, wherein the cleaning unit is spaced from the surface cleaning head when in the storage configuration.

4. The surface cleaning apparatus of claim 2, wherein the cleaning unit comprises a bottom face configured to rest upon a surface and a mounting member engageable with the storage mount and the mounting member is provided on the bottom face.

5. The surface cleaning apparatus of claim 2, wherein the dirt collection chamber comprises at least one openable wall for emptying the dirt collection chamber, and the cleaning unit comprises a mounting member engageable with the storage mount and the mounting member is provided on and is moveable with the openable wall.

6. The surface cleaning apparatus of claim 2, wherein the cleaning unit comprises a mounting member engageable with the support structure when in the storage position and the mounting member at least partially underlies the cyclone chamber and the dirt collection chamber.

7. The surface cleaning apparatus of claim 2, wherein the cleaning unit comprises a mounting member engageable with the storage mount and the mounting member and storage mount are configured to retain the cleaning unit on the storage mount solely due to the influence of gravity.

8. The surface cleaning apparatus of claim 7, wherein the mounting member is removable from the storage mount in the absence of disengaging a locking mechanism.

9. The surface cleaning apparatus of claim 2, wherein the cleaning unit further comprises a front end, back end and a mounting member engageable with the support structure when in the storage position and the mounting member is positioned forward of the suction motor.

10. The surface cleaning apparatus of claim 2, wherein the storage mount comprises an upwardly opening hook member and the cleaning unit comprises a mounting member comprising a slot to receive the hook.

11. The surface cleaning apparatus of claim 2, wherein the storage mount is positioned on a front surface of the support structure and when surface cleaning apparatus is in the storage configuration the mass of the cleaning unit urges the support structure toward the upright position.

12. The surface cleaning apparatus of claim 11, further comprising a first alignment member on the surface cleaning head and a corresponding second alignment member on the support structure, wherein when the support structure is in the upright position relative rotation between the surface cleaning head and the support structure is prevented by engagement between the first and second alignment members.

13. The surface cleaning apparatus of claim 1, wherein the support structure is self-supporting and generally vertically extending when the surface cleaning apparatus is in the storage configuration and the cleaning unit is mounted to the support structure.

14. The surface cleaning apparatus of claim 1, wherein the support structure comprises an elongate rigid suction conduit having a first end and that is connectable to the cleaning head and a second end that is spaced apart from the first end.

15. The surface cleaning apparatus of claim 14, wherein the storage mount is provided toward the first end of the rigid suction conduit.

16. The surface cleaning apparatus of claim 14, wherein the cleaning unit air inlet is connectable in air flow communication to the second end of the rigid suction conduit.

17. The surface cleaning apparatus of claim 16, wherein the cleaning unit air inlet is directly connectable in air flow communication to the second end of the rigid suction conduit.

18. The surface cleaning apparatus of claim 1, wherein the cleaning unit comprises a centre of gravity and when the cleaning unit is in the storage configuration the centre of gravity is positioned above the surface cleaning head.

19. The surface cleaning apparatus of claim 18, wherein when the cleaning unit is in the storage configuration the suction motor is at a higher elevation than the mounting member.

* * * * *